US011592169B2

(12) United States Patent
Hooker et al.

(10) Patent No.: US 11,592,169 B2
(45) Date of Patent: Feb. 28, 2023

(54) LINEAR LED LIGHT SOURCE AND MANUFACTURING METHOD

(71) Applicant: Flowil International Lighting (Holding) B.V., Amsterdam (NL)

(72) Inventors: James Hooker, Aarschot (BE); Frank Broeders, Heverlee (BE); Walter Schaaf, Diest (BE)

(73) Assignee: Flowil International Lighting (Holding) B.V., Amsterdam (NL)

( * ) Notice: Subject to any disclaimer, the term of this patent is extended or adjusted under 35 U.S.C. 154(b) by 0 days.

(21) Appl. No.: 17/282,242

(22) PCT Filed: Oct. 1, 2018

(86) PCT No.: PCT/EP2018/076686
§ 371 (c)(1),
(2) Date: Apr. 1, 2021

(87) PCT Pub. No.: WO2020/069722
PCT Pub. Date: Apr. 9, 2020

(65) Prior Publication Data
US 2021/0348750 A1 Nov. 11, 2021

(51) Int. Cl.
*F21V 29/60* (2015.01)
*F21K 9/272* (2016.01)
(Continued)

(52) U.S. Cl.
CPC ..... *F21V 29/60* (2015.01); *F21K 9/272* (2016.08); *F21K 9/90* (2013.01); *F21V 31/005* (2013.01);
(Continued)

(58) Field of Classification Search
CPC ..... F21V 29/60; F21V 31/005; F21V 31/04; F21K 9/272; F21K 9/90; F21K 9/27; F21Y 2103/10; F21Y 2115/10
See application file for complete search history.

(56) References Cited

U.S. PATENT DOCUMENTS 1,498,908 A 6/1924 Fink
3,746,496 A * 7/1973 Dietze ..... C30B 25/00 118/733
8,400,051 B2 3/2013 Hakata et al.
10,088,142 B1 * 10/2018 McGrath ..... F21V 15/015
(Continued)

FOREIGN PATENT DOCUMENTS

CN 203656626 U 6/2014
CN 106574753 A 4/2017
(Continued)

OTHER PUBLICATIONS

International Search Report and Written Opinion for International Application No. PCT/EP2018/076686, filed Oct. 1, 2018, dated Dec. 17, 2018.

*Primary Examiner* — Tsion Tumebo
(74) *Attorney, Agent, or Firm* — Fox Rothschild LLP

(57) ABSTRACT

The present invention relates to a method for manufacturing a linear LED light source, comprising: providing a tubular glass envelope that is open at its proximal end and its distal end; inserting a light source mount assembly comprising one or more LED units into the tubular glass envelope; forming a distal hermetic seal at the distal end such that a distal opening remains at the distal end; forming a proximal hermetic seal at the proximal end such that a proximal opening remains at the proximal end; filling the tubular glass envelope with a gas filling; and sealing the distal and proximal openings to obtain a sealed lamp envelope; wherein a flow of coolant gas through the tubular glass
(Continued)

envelope is maintained during the formation of the proximal hermetic seal and/or distal hermetic seal if the light source mount assembly is inserted before the formation of the respective hermetic seal.

22 Claims, 5 Drawing Sheets

(51) Int. Cl.

| | |
|---|---|
| ***F21K 9/90*** | (2016.01) |
| ***F21V 31/00*** | (2006.01) |
| ***F21Y 103/10*** | (2016.01) |
| ***F21Y 115/10*** | (2016.01) |

(52) U.S. Cl.
CPC ..... *F21Y 2103/10* (2016.08); *F21Y 2115/10* (2016.08)

(56) References Cited

U.S. PATENT DOCUMENTS

| | | | | |
|---|---|---|---|---|
| 2009/0184643 | A1* | 7/2009 | Hooker | H01J 61/82 313/631 |
| 2013/0039838 | A1* | 2/2013 | Lashmore | B82Y 40/00 977/750 |
| 2016/0102822 | A1* | 4/2016 | Van Delden | F21K 9/27 313/512 |
| 2017/0268730 | A1* | 9/2017 | Cai | F21V 29/83 |
| 2018/0216787 | A1 | 8/2018 | Chung et al. | |

FOREIGN PATENT DOCUMENTS

| | | | |
|---|---|---|---|
| EP | 2108880 | A2 | 10/2009 |
| EP | 2292970 | A2 | 3/2011 |
| EP | 3155314 | B1 | 11/2017 |
| JP | 2018078091 | A | 5/2018 |

* cited by examiner

LINEAR LED LIGHT SOURCE AND MANUFACTURING METHOD

CROSS-REFERENCE TO RELATED APPLICATION

The present application is a § 371 U.S. National Phase Entry of International Patent Application No. PCT/EP2018/076686, filed on Oct. 1, 2018, the entirety of which is hereby incorporated herein by reference.

TECHNICAL FIELD

The present invention relates to a manufacturing method for a linear LED light source, and a linear LED light source.

BACKGROUND

In LED filament light sources, light is generated by means of LED filaments—multi-LED structures that resemble the filament of an incandescent light bulb. LED filaments consist of multiple LEDs connected in series on a transparent substrate, allowing the light emitted by the LEDs to disperse evenly and uniformly. Commonly, a coating of yellow phosphor in a resin binder material converts the blue light generated by the LEDs into white light. An example for a LED filament light source is disclosed in U.S. Pat. No. 8,400,051 B2.

LED filament lamps are conventionally filled with a thermally conductive gas. The reason is that LED filaments are omnidirectional light sources, and they therefore cannot be attached to a conventional heat sink (for instance a metallic or thermally conductive polymer substrate) owing to the opaque nature of such heat sinks. This would block the radiation of light in one direction and render the concept of the omnidirectional LED filament useless. LED filaments are therefore cooled by optically transparent means, for instance the gases mentioned above.

Both hydrogen and helium are characterised by their high thermal conductivity, due in part to their exceptionally small atomic diameter (or molecular diameter in case of hydrogen), and these gases will diffuse through many transparent materials traditionally used for LED lamp envelopes—for instance translucent plastics, along with quartz and many hard glasses, etc. However the permeability through ordinary soft glasses is sufficiently slow that such gases can be contained within envelopes made of these materials sufficiently long to attain a useful lamp lifetime. It has therefore been established that the best gas-cooled LED filament lamps are constructed using soft-glass envelopes filled with a heat conductive gas of low atomic mass.

Also of concern is the quality of the glass-to-metal seals in which electrical current-carrying conductors are brought through the glass envelope. Typical adhesive materials are also porous to the light gases, therefore a hermetic seal must be formed directly from the glass envelope to a metallic conductor having a suitably matched coefficient of thermal expansion to obtain a gas-tight seal, according to the techniques long established in the manufacture of electric lamps and associated glass vacuum devices. An example for such a seal is disclosed in U.S. Pat. No. 1,498,908. The formation of such seals calls for the fusion of the glass at high temperatures, which may be deleterious to the LED filaments in close proximity owing to the use of polymeric and other thermally unstable materials in their construction.

In order to avoid such damage to LED filaments (or other thermally sensitive elements), the elements in question are arranged inside the glass envelope with a certain distance from the seal formation regions, so that the high temperatures occurring in the seal formation region during the seal formation process do not compromise the integrity of these elements. This leads to the formation of a non light-emitting dead zone in the vicinity of the seal formation region.

It is thus desirable that the light emission should extend much closer to regions of the lamp that are sealed during the manufacturing process. This need is particularly prominent for linear LED light sources which have a glass envelope of essentially cylindrical shape and a plurality of LED units that are arranged along the longitudinal axis of the glass envelope. Such linear LED light sources are now commonly employed to replace fluorescent tube type light sources. Here, the ends of the glass envelope are usually sealed in the manufacturing process. Owing to the incineration and destruction of the LEDs when they are brought closer to a seal formation region of the glass tube, the production of double-ended LED filament tube lamps has proven particularly difficult.

In light of the above, it is an object of the present invention to provide a linear LED light source with improved radiation characteristics, particularly a linear LED light source in which the light-emitting source extends over substantially the entire length of the product.

SUMMARY OF THE INVENTION

The above object is solved by a manufacturing method, as well as by a linear LED light source disclosed herein. Preferred embodiments of the invention are indicated by the subject-matter of the dependent claims.

The present invention specifically relates to a linear LED light source in which LED units are linearly arranged in an elongated, substantially cylindrical translucent lamp envelope, such as a glass tube. The present invention is applicable to conventional linear LED light sources in which multiple discrete LEDs are used in the LED units, as well as to linear LED filament light sources.

Specifically, the present invention provides a manufacturing method for a linear LED light source, comprising:

- providing a tubular glass envelope that is open at its proximal end and its distal end;
- inserting a light source mount assembly with one or more LED units into the tubular glass envelope;
- forming a distal hermetic seal at the distal end such that a distal opening remains at the distal end;
- forming a proximal hermetic seal at the proximal end such that a proximal opening remains at the proximal end;
- filling the tubular glass envelope with a gas filling;
- sealing the distal and proximal openings to obtain a sealed lamp envelope;

wherein a flow of coolant gas through the tubular glass envelope is maintained during the formation of the proximal hermetic seal and/or distal hermetic seal if the light source mount assembly is inserted before the formation of the respective hermetic seal.

A core concept of the present invention lies in the provision of the coolant gas flow during the formation of hermetic seals at the ends of the glass envelope that serves to provide a temporary cooling effect to surrounding temperature sensitive elements of the light source mount assembly. The formation of the hermetic seals is usually performed by heating the ends of the glass envelope in order to achieve a softening and deformation of the glass material. The temperatures involved in the seal formation would normally lead to the incineration of adjacent LED units and ultimately render the linear LED light source useless.

However, in the present invention, the directed flow of coolant gas through the glass envelope can keep the thermally fragile LED units below about 250° C., even though the glass envelope just a few millimetres away is heated to its working temperature in excess of 1200° C. Thus, the LED units can be positioned much closer to the proximal and distal ends of the sealed glass envelope than with conventional manufacturing methods. The manufacturing method of the present invention thus enables the production of linear LED light sources in which the light-emitting source constituted by the LED units extends over substantially the entire length of the product.

Owing to the provision of the distal and proximal openings for the influx and egress of coolant gas, the flow of coolant gas can be maintained essentially throughout the entire sealing process. In conventional lampmaking techniques, as soon as one end of the lamp envelope is sealed, any coolant gas flow that might have been provided previously must be interrupted, in order to avoid an increase of pressure within the lamp vessel and undesirable inflation of the softened glass in the sealing zone. In case thermally sensitive LED units are being sealed into such a kind of tubular lamp envelope, the interruption of coolant flow is not tolerable, since the LEDs would still be heated above their destruction temperature by conduction and convection of heat from the hot glass wall via the stationary volume of trapped gas to the LEDs.

Moreover, the directed nature of the coolant gas flow with the present invention avoids the undesirable chilling of the sides of the lamp envelope in the vicinity of the seal zone, which would interfere with the glass sealing process and lead to residual stresses in the glass envelope that may lead to cracking and failure of the lamp.

The flow of coolant gas is preferably introduced via either the distal opening or the proximal opening. During formation of the hermetic seal at the proximal end, the coolant gas is preferably introduced on the proximal side and vice versa. The flow of coolant gas impinges upon the adjacent LED units to provide the temporary cooling effect.

It is noted that the order of the method steps according to the invention is not fixed. Specifically, the order of the steps of inserting a light source mount assembly and forming the first hermetic seal may be swapped. A hermetic seal may be formed at one end of the tubular glass envelope, preferably the distal end, before the light source mount assembly is inserted, preferably from the proximate end. Subsequently, the formation of the proximal hermetic seal may be performed.

It is only mandatory that the flow of coolant gas is provided when a hermetic seal formation is performed with the light source mount assembly already inserted, in order to protect the LED units in the vicinity of the seal formation region from overheating. It has to be ensured that the flow of coolant gas is maintained at least over a substantial fraction of the time required for forming the seal in the vicinity of which the LED units are arranged such that the overheating of the LED units is prevented. Obviously, the steps of filling the tubular glass envelope with a gas filling and sealing the distal and proximal openings are performed after the insertion of the light source mount assembly and formation of the hermetic seals.

As material of the sealed glass envelope, a high purity version of ordinary soda-lime silicate is preferred. Particularly preferred is a high purity version of ordinary soda-lime silicate with low iron oxide content. A particularly preferable choice for the material of the sealed glass envelope is a soda lime silicate soft glass with high alkaline content, consisting of 69-75 wt % of $SiO_2$, 14-19 wt % of $Li_2O$, $Na_2O$ and/or $K_2O$, 6-10.5 wt % of MgO, CaO, SrO and/or BaO, 1.5-3 wt % of $Al_2O_3$ and/or $B_2O_3$, the remainder being unavoidable impurities. Such glass is favorable due to a low working temperature of around 1300 K and a high coefficient of linear expansion in the range of $85\text{-}90 \cdot 10^{-6}\ K^{-1}$.

In a preferred embodiment, the diameter of the distal opening and/or the diameter of the proximal opening has a smaller diameter than the diameter of the tubular glass envelope. This facilitates the sealing of the proximal and distal openings after filling the lamp with the gas filling.

It is further preferred that the forming of the distal hermetic seal comprises the steps of inserting a second glass tube into the distal end such that an end of the second glass tube protrudes beyond the distal end to the outside of the tubular glass envelope; and forming the distal hermetic seal at the junction of the tubular glass envelope and the second glass tube by heating the distal end in order to collapse the distal around the second glass tube.

Similarly, it is preferred that the forming of the proximal hermetic seal comprises the steps of inserting a third glass tube into the proximal end such that an end of the third glass tube protrudes beyond the proximal end to the outside of the tubular glass envelope; and forming the proximal hermetic seal at the junction of the tubular glass envelope and the third glass tube by heating the proximal end in order to collapse the proximal end around the third glass tube.

The preferred method of forming the distal and proximal hermetic seals bears the advantage that the hermetic seals are obtained through glass working, which ensures a gas-tight sealing of the proximal and distal ends. This prolongs the lifetime of the linear LED light source. The glass tubes provide a proximal and distal opening through which the flow of coolant gas can be conveniently introduced.

It is further preferred that the light source mount assembly is provided with at least one electrical feedthrough component connected thereto, wherein the electrical feedthrough component is arranged to protrude beyond the proximal end to the outside of the tubular glass envelope when the light source mount assembly is inserted into the tubular glass envelope, and wherein, in the forming of the proximal hermetic seal, the proximal end is heated such that the proximal end collapses around the electrical feedthrough component to form a hermetic seal around the electrical feedthrough component. It can thus be ensured that an electrical connection for the light source mount assembly to the outside of the sealed lamp envelope is hermetically sealed without having an adverse impact on the gas-tightness of the lamp envelope.

In a further preferred embodiment, the method comprises the following steps before inserting the light source mount assembly into the tubular glass envelope: providing a stem assembly with an integral gas flow tube through which gas can flow, that is hermetically sealed to an electrical feedthrough component; and connecting the stem assembly to the light source mount assembly. When inserting the light source mount assembly into the tubular glass envelope, the stem assembly is partially inserted into the tubular glass envelope, with the integral gas flow tube protruding beyond the proximal end. The forming of the proximal hermetic seal is performed at the junction of the tubular glass envelope and the stem assembly by heating the proximal end in order to collapse the proximal end around the stem assembly.

According to this embodiment, the electrical feedthrough component is hermetically sealed to the stem assembly before being connected to the light source mount assembly. Thus, the hermetic sealing of the electrical feedthrough component can be performed with high precision, ensuring a gas-tight sealing of the electrical feedthrough component in a glass component. The actual formation of the proximal seal only comprises a fusing of glass, which simplifies the production of the hermetic proximal seal. The stem assembly with the integral gas flow tube is configured to allow for a flow of gas when it is inserted into the tubular glass envelope and the proximal hermetic seal is formed, so that the flow of coolant gas towards the LED units of the light source mount assembly can be provided throughout the process of forming the proximal hermetic seal. The stem assembly is constituted by a pre-formed hermetically sealed glass-to-metal stem assembly bearing an integrally fused gas flow tube.

It is further preferred that the stem assembly is configured such that the flow of coolant gas through the tubular glass envelope is directable along the longitudinal axis of the tubular glass envelope. With such a configuration, the flow of coolant gas is immediately directable at the light source mount assembly. This can be achieved by configuring the stem assembly such that the integral gas flow tube of the stem assembly has an opening that is arranged axially and in line with the tubular glass envelope, such that the flow of coolant gas provided during formation of the proximal hermetic seal is directed at the light source mount assembly. With this configuration, the cooling effect on the LED units in the vicinity of the stem assembly that are most prone to thermal damages during the formation of the proximal hermetic seal may be distinctly improved, in contrast to a stem assembly in which the opening of the integral gas flow tube is arranged such that the flow of coolant gas enters the tubular glass envelope in the side of the stem assembly.

Preferably, the electrical feedthrough component comprises a controlled expansion alloy or is made of a controlled expansion alloy. It is preferred that the electrical feedthrough component has a vacuum-tight adhesion to glass. Since the part of the electrical feedthrough component that is sealed in the proximate hermetic seal is heated to extremely high temperatures, it is advantageous to limit the thermal deformation of the electrical feedthrough component which might compromise the integrity of the proximate hermetic seal when it is cooled down after the seal formation.

In a further preferred embodiment, the method comprises the step of applying bases at the distal end and/or the proximal end of the sealed lamp envelope. The bases cap the ends of the sealed glass tube, thus serving as protection. The bases may be equipped with electrical contacts or plugs or other mechanical features that may serve to provide an electro-mechanical connection of the linear LED light source with corresponding sockets. The bases may be attached to the proximal and/or distal end by an adhesive or other mechanical means.

It is further preferred that the distal hermetic seal is formed before the light source mount assembly is inserted into the tubular glass envelope. The light source mount assembly may then be inserted from the proximal end.

Preferably, the flow of coolant gas is introduced through the third glass tube before forming the proximal hermetic seal and maintained throughout the formation of the proximal hermetic seal. Introducing the gas flow in this manner bears the advantage that the gas flow is directly directed towards adjacent LED units, thus improving the cooling effect.

It is further preferred that the flow of coolant gas comprises nitrogen or argon or a mixture thereof. For the flow of coolant gas, however, also dry air may be used. Furthermore, any inert gas is suitable to be used as coolant gas. Nitrogen and argon are particularly preferred for cost reasons and for the fact that they are commercially provided virtually free of water. Preferably, the flow of coolant gas consists of nitrogen, argon or a mixture thereof.

Preferably, the gas filling comprises hydrogen or helium or a mixture thereof. Hydrogen and helium both exhibit a low atomic mass and are therefore particularly suitable as gas filling for linear LED light sources, since they exhibit a high thermal conductivity, thus enabling an efficient cooling of the LED units.

In a further preferred embodiment the sealing of the first opening and/or the sealing of the second opening comprises fusing and removing the protruding ends of the second glass tube and/or third glass tube, preferably by heating. This ensures a hermetic sealing of the openings in order to produce a gas-tight sealed glass envelope. The sealing of the first opening and/or the second opening is performed after filling the tubular envelope with the gas filling.

It is further preferred that at least one LED unit is constituted by a LED filament. LED filaments have a substantially omnidirectional light radiation pattern, thus they allow making full use of the cylindrical light transmissive sealed lamp envelope and internal gas-cooling medium. It should, however, be emphasised that the present invention is also applicable to conventional linear LED light sources in which the LED units are constituted by LEDs of all types of packages mounted on a printed circuit board or an equivalent carrier and arranged inside the sealed lamp envelope.

Furthermore, it is preferred that the distance between the proximal end of the sealed lamp envelope and the nearest LED unit is smaller than four times, preferably three times, more preferably twice the diameter of the sealed lamp envelope, and/or that the distance between the distal end of the sealed lamp envelope and the nearest LED unit is smaller than four times, preferably three times, more preferably twice the diameter of the sealed lamp envelope. This ensures an extension of the light-emitting sources over essentially the full usable length of the linear LED light source.

The object of the present invention is further solved by a linear LED light source preferably manufactured by a method described above, comprising:

a sealed lamp envelope; and a light source mount assembly with one or more LED units arranged inside the sealed lamp envelope;

wherein the sealed lamp envelope is of essentially cylindrical shape, and wherein the distance between a distal end and/or proximal end of the sealed lamp envelope and the LED unit nearest to said end of the sealed lamp envelope is smaller than four times, preferably three times, more preferably twice the diameter of the sealed lamp envelope.

Since the distance between the distal ends of the sealed lamp envelope and the LED units is limited to less than twice the diameter of the sealed lamp envelope, the linear LED light source according to the invention provides improved radiation characteristics, since the light-emitting source extends over substantially the entire length of the product and the dimensions of the non-emitting dead zones at the ends of the linear LED light source are minimised.

In a preferred embodiment, the LED units are sequentially arranged along the longitudinal axis of the sealed lamp envelope. Thus, the entire length of the sealed envelope is used for light emission.

It is further preferred that at least one LED unit is constituted by a LED filament. LED filaments bear the advantage of providing an omnidirectional light radiation pattern.

In a further preferred embodiment, the light source mount assembly comprises support frames to which the LED units are mounted, and that are configured to conduct electric power for driving the LED units. Thus, the support frames serve two functions: on the one hand, a mechanical stabilisation of the arrangement of the LED units that serves to increase the mechanical robustness of the linear LED light source, on the other hand, providing a conductive pathway for the electric power required to drive the LED units. Since the mount frame serves two functions, the number of parts required for the linear LED light source can be reduced, which aids in improving the radiation characteristics of the linear LED light source, because fewer components that may block part of the radiation emitted by the LED units have to be arranged in the sealed lamp envelope.

The support frames are preferably made from a metallic material with good conductivity and are preferably manufactured from wires, preferably with a diameter of 1.5 mm or less, to reduce blockage of emitted light. The cross-sectional shape of the support frames is not particularly limited and may be circular. Alternatively, the support frames may be manufactured from metal strips or sheets having a non-circular cross section to further limit optical shadowing and increase mechanical strength.

It is preferred that the metallic support frames are manufactured from an alloy and with a diameter such that they have an electrical resistance R/l between 50 mΩ/m and 200 mΩ/m. Conventionally, steel wires are used for the support frames of LED light sources. However, steel wires are characterised by a high electrical resistance, which causes an unfavorable voltage drop, leading to current imbalances between the different LED units. Using an alloy with the above-mentioned properties for the metallic support frames greatly reduces electrical resistance, which allows the diameter of the wires to be minimised and the luminous flux and efficacy of the linear light source to be maximised.

The electrical resistance R/l as defined in the context of this invention denotes electrical resistance per length unit with the unit mΩ/m (milliohms per metre). It is calculated from the specific electrical resistance or electrical resistivity of the used alloy, ρ, which is a material specific constant and usually given in units of Ω·m (ohm-metres) at a temperature of the alloy of 20° C., and the cross-sectional area A of the metallic support frame, which is usually expressed in $mm^2$, according to the formula $$\frac{R}{l} = \frac{\rho}{A}$$

With support frames having the characteristics according to the present invention, the voltage drop in the metallic support frames can be dropped to acceptable levels of less than approximately 100 millivolts per metre. Thus, a linear LED light source with considerably greater length than in the prior art can be manufactured.

Preferably, the metallic support frames are manufactured from an alloy and with a diameter such that they have an electrical resistance between 50 mΩ/m and 150 mΩ/m, more preferably 90 mΩ/m to 120 mΩ/m. It is preferred that the metallic support frames are manufactured from nickel or a nickel alloy, preferably a nickel-manganese alloy. These alloys have a very low specific electrical resistance and favorable mechanical properties.

Materials such as copper and its alloys are known to be used as materials for the wiring in electric lamps, and specifically for the tracks of printed circuit boards to which traditional LEDs are normally attached. However, copper is a very soft metal which is not mechanically robust, and which is also very difficult to attach to the LED filaments by conventional techniques such as resistance welding. Nickel and its alloys overcome these problems, providing a metal alloy with low specific electrical resistance, high mechanical stability and good weldability. The high mechanical stability enhances the reliability of the linear LED light source, since the support frame is less prone to deformation.

Preferably, the metallic support frames are manufactured from a metal alloy that consists of 1 to 3 wt % manganese (Mn), preferably 2 wt % manganese (Mn), the remainder being nickel (Ni) and inevitable impurities. This alloy has been found to be specifically suitable due to its good mechanical and welding properties along with favorably low values for the electrical resistance R/l that can be achieved with such alloys.

Preferably, two support frames are provided, each being conductively connected to an electrical contact of the linear LED light source, and the LED units are connected between the two support frames in parallel. This allows operating the LED units in parallel. It should be noted that the present invention is not limited to LED units operated in parallel. Other mount frame constructions might be conceived for series operation.

It is further preferred that the light source mount assembly comprises buffer springs that are configured to support the support frames against the inner wall of the sealed lamp envelope. With this, the mechanical stability of the linear LED light source and the risk of its lifetime being prematurely terminated by breakage can be improved.

In a further preferable embodiment, the light source mount assembly comprises isolating bridges that are provided between the support frames and are configured to maintain a fixed relative position between the metallic support frames. This serves to further improve the mechanical stability of the light source mount assembly. Preferably, the isolating bridges are arranged adjacent to the proximal and distal ends of the sealed lamp envelope, respectively. Thus, the isolating bridges can support the mechanical stability of the light source mount assembly whilst minimizing the blockage of emitted light. However, intermediate isolating bridges may be provided for mechanical support of different configurations of light source mount assemblies.

In a further preferred embodiment, the gas filling consists of a thermally conductive gas of low atomic mass containing fewer than 50,000 ppm (parts per million) of impurities, preferably fewer than 10,000 ppm, more preferably fewer than 1,000 ppm, further more preferably fewer than 100 ppm. The gas filling preferably consists of hydrogen or helium with the specified high chemical purity. It is furthermore preferred that the sum of the contents of oxygen, nitrogen, argon and hydrocarbon vapours in the gas filling is 50,000 ppm or lower, preferably 10,000 ppm or lower, more preferably 1,000 ppm or lower, further more preferably 100 ppm or lower. Surprisingly, it has been found that the premature failure of conventional linear LED light sources, particularly linear LED filament light sources, can be attributed to properties of the gas filling of the lamps. With a gas filling in compliance with the above-mentioned limitations for the constituent components, the lifetime of the linear LED light source can be elongated.

BRIEF DESCRIPTION OF THE FIGURES

The above and further features and advantages of the invention will become more readily apparent from the following detailed description of preferred embodiments of the invention with reference to the accompanying drawings, in which like reference signs designate like features, and in which.

DETAILED DESCRIPTION

Figure 1:
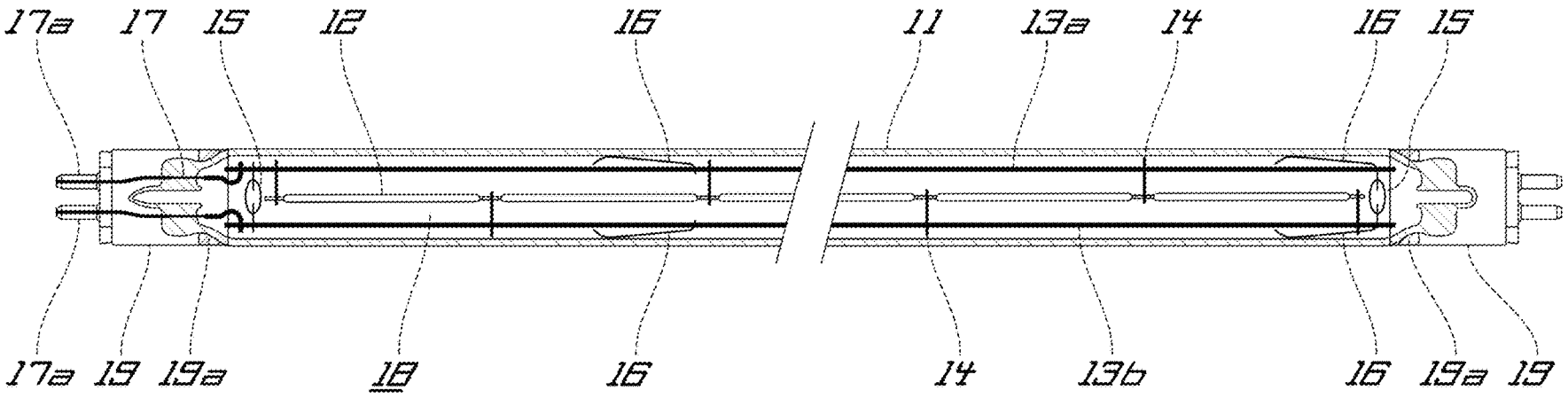
FIG. 1 shows a schematic view of a linear LED light source according to an embodiment of the present invention.

FIG. 1 is a schematic view of a linear LED light source according to an embodiment of the present invention. The linear LED light source comprises a sealed lamp envelope 11 of essentially cylindrical shape that is translucent and made of glass. A light source mount assembly 10 is arranged inside the sealed lamp envelope 11. In the present embodiment, the light source assembly 10 comprises multiple LED units 12 mounted to metallic support frames 13*a*, 13*b* optionally via metallic spacer components 14, isolating bridges 15 and buffer springs 16.

The light source assembly 10 is connected to an electrical feedthrough component 17. Specifically, the metallic support frames 13*a*, 13*b* are conductively connected, e.g. welded or soldered to the electrical feedthrough component 17.

The LED units 12 of the present embodiment are constituted by LED filaments. The LED units 12 are sequentially aligned along the longitudinal axis of the sealed lamp envelope 11 and disposed essentially along the entire length of the sealed lamp envelope 11.

The metallic support frames 13*a*, 13*b* which carry the LED units 12 are supported against the inner wall of the sealed lamp envelope 11 by buffer springs 16 which serve to maintain the LED units 12 and the support structure of the support frames 13*a*, 13*b* along the axis of the sealed lamp envelope 11. They also serve to prevent physical damage by absorbing mechanical shocks that may be experienced during handling and transportation of the linear LED light source.

The optional metallic spacer components 14 may serve to orientate the LED units 12 in a particular mechanical configuration—in the present embodiment, in a linear configuration extending over the most part of the length of the sealed glass envelope 11. However it will be appreciated that many different mechanical configurations of the LED units 12 are possible, which may or may not require the utilisation of metallic spacer components 14. In order to further stabilise the assembly of the LED units 12 and metallic spacer components 14, electrically isolating bridges 15 are provided near the respective ends of the sealed lamp envelope 11 to maintain a fixed relative position between the metallic support frames 13*a*, 13*b*, and may also optionally be provided at intermediate locations.

The isolating bridges 15 may be formed, for instance, from a dielectric material such as glass or ceramic bearing electrically isolated metallic wires for convenient welding to the support frames 13*a* 13*b*. The buffer springs 16 may be combined into the same physical assembly as the isolating bridges 15, as can be seen at the right end of the sealed lamp envelope 11.

The sealed lamp envelope 11 is filled with a gas filling 18 that is preferably a gas of low atomic weight like hydrogen, helium or a mixture thereof.

The sealed lamp envelope 11 may optionally be capped by bases 19 at one or both ends. The left base 19 is equipped with electrical contacts 17*a* that are connected to the electrical feedthrough components 17. The bases 19 are attached to the sealed lamp envelope 11 by an adhesive 19*a*. Although FIG. 1 depicts a linear LED light source with a pair of electrical contacts 17*a* at the same end of the linear LED light source, it should be noted that the electrical contacts 17*a* may also be arranged with one electrical contact 17*a* at each end of lamp, or with a plurality of electrical contacts 17*a* at both ends of the lamp.

The electrical feedthrough components 17 electrically connect the light source mount assembly 10 to the exterior of the sealed lamp envelope 11. The electrical feedthrough components 17 are hermetically sealed into the sealed lamp envelope 11 in a gas-tight fashion to avoid leakage of the gas filling 18.

Electrical power is fed to the linear LED light source via the electrical contacts 17*a*, through the electrical feedthrough components 17 to the metallic support frames 13*a*, 13*b*. If present, the metallic spacer components 14 are connected to the metallic support frames 13*a*, 13*b* and provide a conductive connection between the metallic support frames 13*a*, 13*b* and the LED units 12. Alternatively the LED units 12 may be connected directly to the metallic support frames 13*a*, 13*b* without the use of intermediate metallic spacer components 14. The metallic spacer components 14 and LED units 12 are arranged such that the LED units 12 are connected in parallel between the metallic support frames 13*a*, 13*b*. However, it should be noted that the scope of the present invention is not limited to constructions in which the LED units 12 are operated in parallel. Other mount frame constructions might be applied for series operation.

The metallic support frames 13*a*, 13*b* and the metallic spacer components 14 not only serve not only serve as mechanical support frame for the LED units 12, but also as supply conductors via which electrical power supplied from the electrical contacts 17*a* is fed to the LED units 12.

The metallic components of the light source mount assembly 10 and the electrical feedthrough component 17 can be connected in any suitable manner that ensures a conductive connection between them, e.g. by welding.

Figure 2:
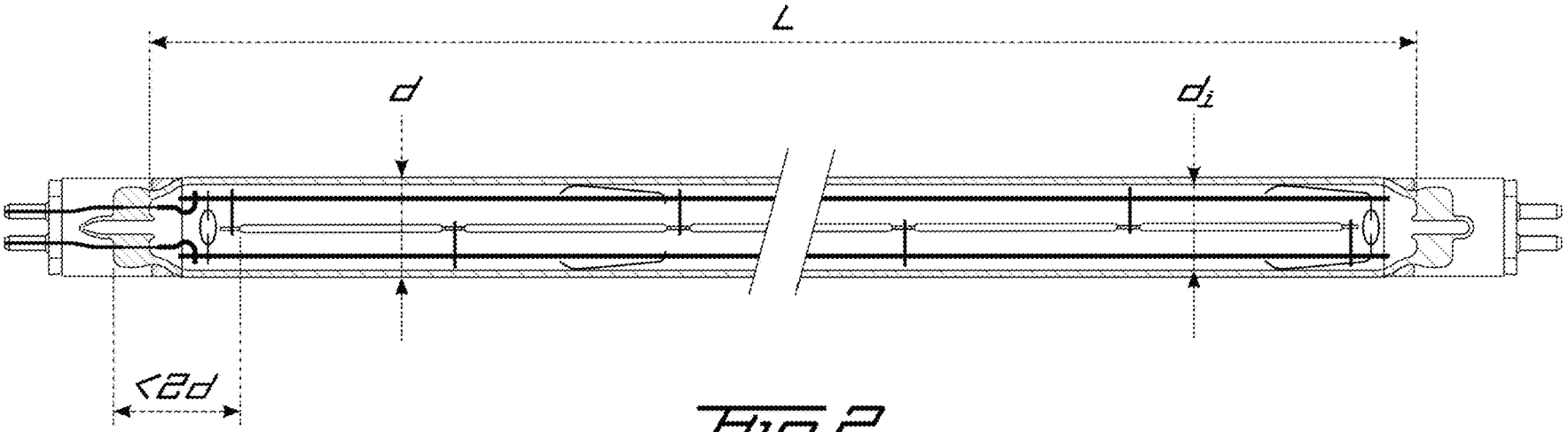
FIG. 2 is a schematic view of the linear LED light source of FIG. 1 in which relevant dimensional parameters are specified.

FIG. 2 serves to illustrate relevant dimensional parameters of the linear LED light source of FIG. 1. The outer diameter of the sealed glass envelope 11 and, thus, of the linear LED light source, is denoted by d. The inner diameter of the sealed glass envelope is denoted by $d_i$. L designates the inner length of the sealed glass envelope 11, which represents a usable length L of the linear LED light source from which light can be potentially emitted.

As can be seen in FIG. 2, the light-emitting source constituted by the sequentially arranged LED units 12 extends substantially over the entire usable length L of the linear LED light source. More precisely, the distance between the inner ends of the sealed glass envelope 11 and the nearest LED unit 12 is smaller than twice the outer diameter of the sealed lamp envelope 11. Thus, the length of the non-radiating zones at each end of the linear LED light source does not exceed two times the outer diameter d of the linear LED source. This limitation is a preferred embodiment—the length of the non-radiating zones at each end of the linear LED light source could also be limited to not exceed three times or four times the outer diameter d of the linear LED source.

Figure 3A:
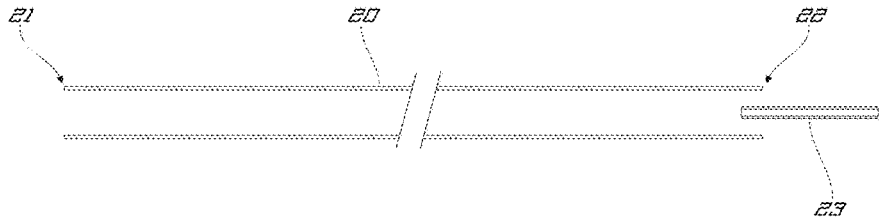
FIG. 3*a*-3*g* illustrate a method for manufacturing a linear LED light source according to an embodiment of the present invention.

FIGS. 3*a* to 3*g* illustrate steps of a method for manufacturing the linear LED light source of FIGS. 1 and 2. As is shown in FIG. 3*a*, in a first step, a tubular glass envelope 20 is provided. The tubular glass envelope 20 has a proximal end 21 and a distal end 22 and is open at both ends. A first glass exhaust tube 23 with smaller diameter than the tubular glass envelope 20 is inserted into the tubular glass envelope 20 at the distal end 22 such that a part of the first exhaust tube 23 is arranged inside the tubular glass envelope 20 and the remaining part of the first exhaust tube 23 protrudes beyond the distal end 22 of the tubular glass envelope 20 to the outside. The first exhaust tube 23 is also open at both ends, thus being essentially formed as a cylinder sleeve that is open at the two ends.

Figure 3B:
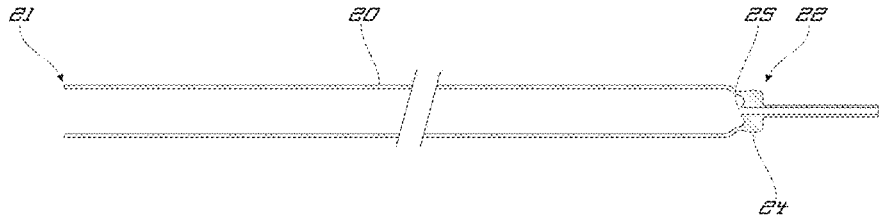

Subsequently, the distal end 22 of the tubular glass envelope 20 is heated at the junction of the first exhaust tube 23 and the tubular glass envelope 20. The glass at the distal end 22 of the tubular glass envelope 20 softens and is formed around the first exhaust tube 23. Thus, a distal hermetic seal 24 is formed at the distal end 22, wherein a distal opening 25 is present along the axis of the distal hermetic seal 24. This is shown in FIG. 3*b*.

The distal opening 25 is provided by the first exhaust tube 23 around which the distal hermetic seal 24 is formed. The distal opening 25 will later be required for allowing a flow of coolant gas 29 through the tubular glass envelope 20. It is therefore pivotal that the formation of the distal hermetic seal 24 is performed such that the distal opening 25 is present after the formation. This can be alleviated, for example, by limiting the temperature attained by the first exhaust tube 23 during formation of the distal hermetic seal 24 and by forming the distal opening 22 of the tubular glass envelope 20 around the first exhaust tube 23 in such a way that any mechanical forces acting on the first exhaust tube 23 are not sufficiently high as to constrict or seal the distal opening 25. Alternatively the first exhaust tube 23 may be fabricated from a type of glass having a slightly higher softening temperature than the tubular glass envelope 20, or other mechanical means may be temporarily or permanently located in the distal opening 25 to maintain its integrity during the formation of the distal hermetic seal 24.

Figure 3C:
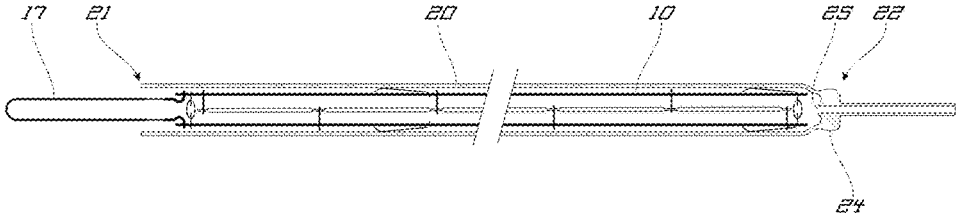

As shown in FIG. 3*c*, the light source mount assembly 10 with the electrical feedthrough component 17 attached thereto is then inserted into the proximal end 21 of the tubular glass envelope 20. The electrical feedthrough component 17 comprises a controlled expansion alloy, i.e., it is at least partially made of a controlled expansion alloy over the length that it is to be hermetically sealed into the distal hermetic seal 24.

The light source mount assembly 10 is arranged such that the electrical feedthrough component 17 protrudes beyond the proximal end 21 of the tubular glass envelope 20 to the outside of the tubular glass envelope 20. The electrical feedthrough component 17 is illustrated in the form of a hairpin to bring two separate sections of wire through the glass, but this is only for the purposes of illustration—it may alternatively be provided as two discrete wires, or a different quantity of wires may be arranged to pass through the hermetic seal.

Figure 3D:
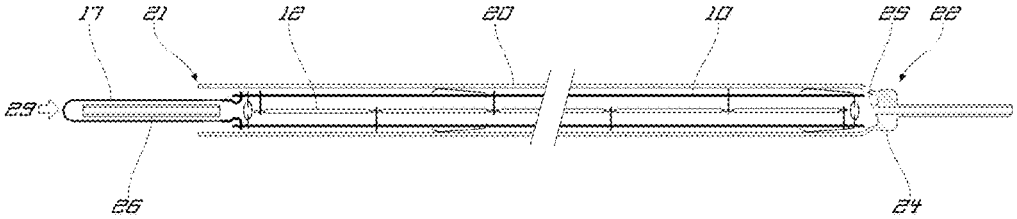

Next, as shown in FIG. 3*d*, a second exhaust tube 26 with smaller diameter than the tubular glass envelope 20 is inserted into the proximal end 21. The second exhaust tube 26 is placed adjacent to the electrical feedthrough component 17, and although located substantially outside the tubular glass envelope 20 the second exhaust tube 26 passes a short distance into the proximal end 21 of the tubular glass envelope 20. As with the first exhaust tube 23, the second exhaust tube 26 is also open at both ends, thus being essentially formed as a cylinder sleeve that is open at the two ends. The second exhaust tube 26 is arranged such that a part of the electrical feedthrough component 17 is positioned in an annular space between the second exhaust tube 26 and the tubular glass envelope 20.

A flow of inert coolant gas 29, for instance nitrogen or argon, is then introduced into the proximal end of the second exhaust tube 26 and the gas issuing from its distal end impinges upon the adjacent LED unit 12 of the light source mount assembly to provide a temporary cooling effect. Thus, it can be ensured that the adjacent LED unit 12 is not damaged when the proximal end 21 of the tubular glass envelope 20 is sealed. Owing to the presence of the first and second exhaust tubes 23, 26 for the influx and egress of coolant gas, the flow of coolant gas 29 can be maintained throughout the entire sealing process.

Figure 3E:
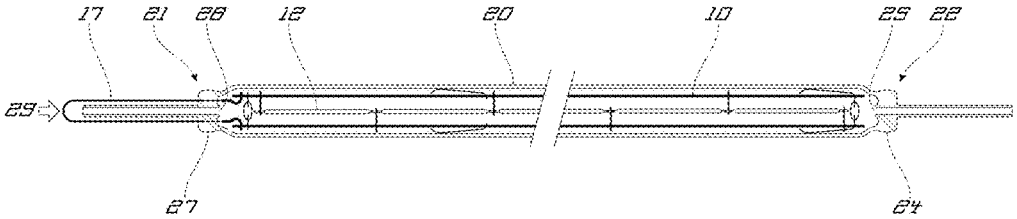

The proximal end 21 of the tubular glass envelope 20 is then heated and collapsed around the electrical feedthrough component 17 and the second exhaust tube 26 to form a proximal hermetic seal 27 with a proximal opening 28, as shown in FIG. 3*e*. Since the electrical feedthrough component 17 is made of a controlled expansion alloy having good adhesion to glass at least in the region that it penetrates the proximal hermetic seal 27, no imperfections are formed in the proximal hermetic seal 27 due to differing thermal expansions of the electrical feedthrough component 17 and the tubular glass envelope 20.

During the entire sealing process, the flow of coolant gas 29 is maintained. The flow of coolant gas 29 enters the proximal end 21 of the tubular glass envelope 20 through a proximal opening 28 that is provided by the second exhaust tube 26, flows through the tubular glass envelope 20 to its distal end 22, from which it is issued via its pre-formed constriction that is constituted by the first exhaust tube 23 with the distal opening 25. Both the proximal and the distal openings 25, 28 should remain substantially unobstructed in order to maintain the flow of coolant gas 29 during the formation of the proximal hermetic seal 27.

After the formation of the proximal hermetic seal 27 is completed and the glass has cooled down sufficiently, the tubular glass envelope 20 is evacuated via one or both exhaust tubes 23, 26, and backfilled with a suitable thermally conductive gas filling 18 that serves to cool the LED units 12 during the subsequent operation of the linear LED light source. The gas filling 18 is introduced via one or both of the exhaust tubes 23, 26 at either or both ends of the tubular glass envelope 20.

Figure 3F:
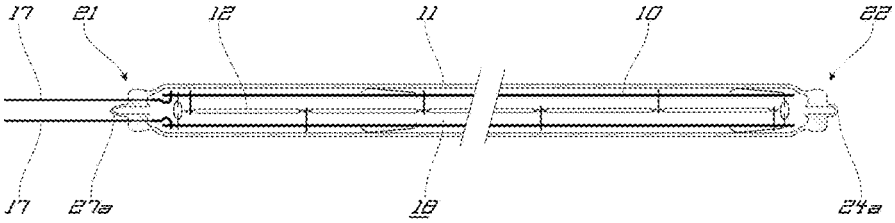
Figure 3G:
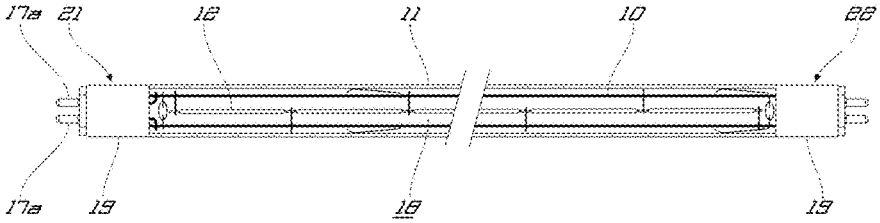

The light source mount assembly 10 and the gas filling 18 are then permanently sealed inside the tubular glass envelope 20 by fusion and removal of the excess length of the protruding ends of the exhaust tubes 23, 26. With the fusion and removal process, a proximal sealing tip 27*a* and a distal sealing tip 24*a* are formed at the respective ends 21, 22 of the tubular glass envelope 20, thus sealing the openings 25, 28 and forming the sealed lamp envelope 11. This is depicted in FIG. 3*f*.

Finally, bases 19 for forming the electrical and/or mechanical interface between the linear LED light source and corresponding sockets or holders may optionally be applied over the proximal and/or distal ends 21, 22 of the sealed lamp envelope 11. In order to establish an electrical contact to the outside, the electrical feedthrough component 17 is shortened to a suitable length and connected to electrical contacts 17*a* of the base 19 at the proximal end 21.

In an alternative, modified embodiment, the formation of the proximal hermetic seal 27 is performed in a different manner. This is schematically depicted in FIGS. 4*a* to 4*h*. Here, the fusing of glass around the electrical feedthrough components 17 and exhaust tubes is performed in a separate process, before connecting the electrical feedthrough components 17 to the light source mount assembly 10. Thus, the modification only concerns the formation of at least the proximal hermetic seal 27, and optionally also the distal hermetic seal 24. The formation of the distal hermetic seal 24 may be performed either as described before or according to this alternative modified embodiment.

Figure 4A:
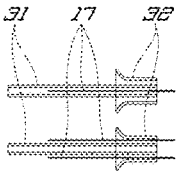
FIG. 4*a*-4*h* illustrate a modified method for manufacturing a linear LED light source according to an embodiment of the present invention.

In the first step shown in FIG. 4*a*, an exhaust tube 31 made of glass is provided and inserted into a flare tube 32 of larger diameter that is also made of glass, so that an annular space between the outer wall of the exhaust tube 31 and the inner wall of the flare tube 32 remains.

One or more electrical feedthrough components 17 may be inserted between the exhaust tube 31 and the flare tube 32 so as to protrude beyond both ends of the flare tube 32. As can be seen in FIG. 4*a*, the electrical feedthrough components 17 are inserted into the annular space between the exhaust tube 31 and the flare tube 32.

Figure 4B:
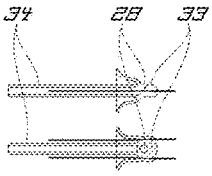

Subsequently, the exhaust tube 31 and the flare tube 32 are joined at their distal ends so as to form a stem assembly 34 that comprises a fused hermetic seal 33 in which the electrical feedthrough components 17 (if present) are hermetically sealed. The joining may be performed by heating and fusing. The finished stem assembly 34 with hermetically sealed electrical feedthrough components 17 is shown in FIG. 4*b*. The electrical feedthrough components 17 protrude beyond both ends of the fused hermetic seal 33, so as to enable an electrical connection on both ends of the electrical feedthrough components 17.

The stem assembly 34 still is configured as a tube, that is, it has an integral gas flow tube constituted by the exhaust tube 31 that has been fused to the flare tube 32 that allows for a gas flow. This channel is formed between the hermetically sealed parts of the electrical feedthrough components 17. It should be noted that the electrical feedthrough component 17 used in this embodiment again comprises a controlled expansion alloy at least in the portion of its passing through the fused hermetic seal 33, so as to have a good adhesion to glass to attain a satisfactory hermetic seal.

It is essential that the fusing of the exhaust tube 31 and the flare tube 32 is performed such that the exhaust tube 31 is not fully collapsed, so that the integral gas flow tube forming a channel for a gas flow can be provided. This can be achieved, for example, by first fusing the distal ends of the exhaust tube 31 and the flare tube 32 together in the vicinity of the hermetic seal 33, and then introducing air pressure into the proximal end of the exhaust tube 31 with sufficient force as to blow one or more small holes in the side of the hermetic seal 33. In the embodiment shown in FIG. 4*b*, the joining of the exhaust tube 31 and the flare tube 32 was performed such that an opening 28 at the distal end of the fused exhaust tube 31 and flare tube 32 remained.

Figure 4C:
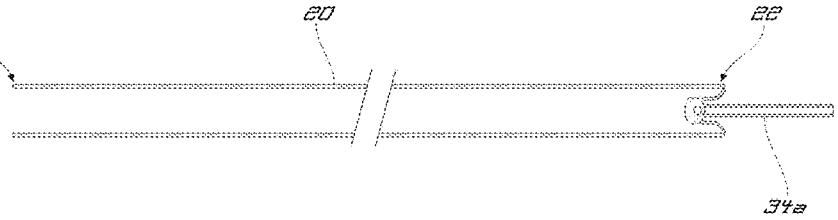
Figure 4D:
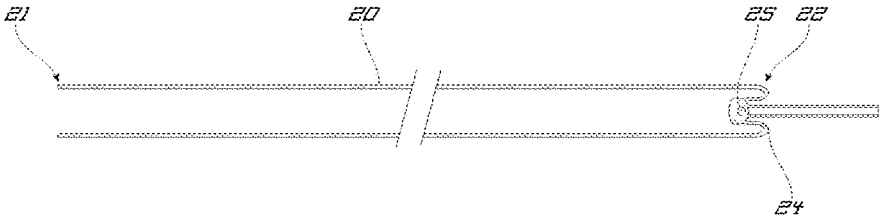

As previously stated, the formation of the distal hermetic seal 24 may be performed in accordance with the embodiment of FIGS. 3*a* and 3*b*, but may also be provided in accordance with the same method for the sealing of a stem assembly 34 of the kind just described, into the tubular glass envelope 20 and as illustrated in FIGS. 4*c* and 4*d*. In this case a distal stem assembly 34*a* is inserted into the distal end 22 of the tubular glass envelope 20 such that the rim of the flared portion is approximately aligned with the rim of the distal end 22.

Heat is subsequently applied to the region to be sealed and the distal end 22 of the tubular glass envelope 20 is collapsed onto the flared rim of the distal stem assembly 34*a* so as to form a distal hermetic seal 24. For the embodiment illustrated in FIGS. 4*c* and 4*d* no electrical feedthrough components 17 have been provided within the distal stem assembly 34*a*.

Figure 4E:
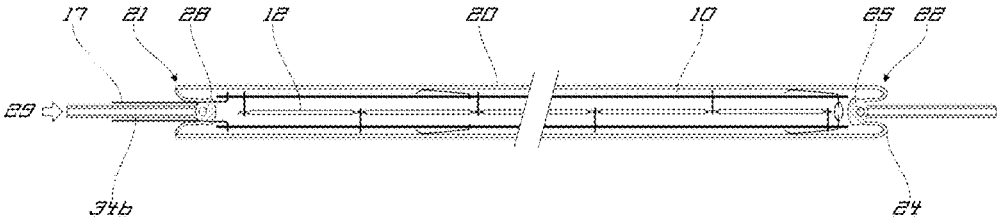

After the formation of the distal hermetic seal 24, a proximal stem assembly 34*b*, this time bearing the electrical feedthrough components 17 as illustrated in FIG. 4*b*, is connected to the light source mount assembly 10, which is inserted into the tubular glass envelope 20 via its open proximal end 21. This is shown in FIG. 4*e*.

A flow of coolant gas 29 is then introduced through the exhaust tube of the proximal stem assembly 34*b* and enters the tubular glass envelope 20 through the opening 28, to provide a cooling effect on the LED units 12 in the vicinity of the proximal end 21. Again, the provision of the proximal opening 28 and the distal opening 25 is pivotal for ensuring the maintenance of the flow of coolant gas 29 throughout the entire formation of the proximal hermetic seal 27 that is performed next.

Figure 4F:
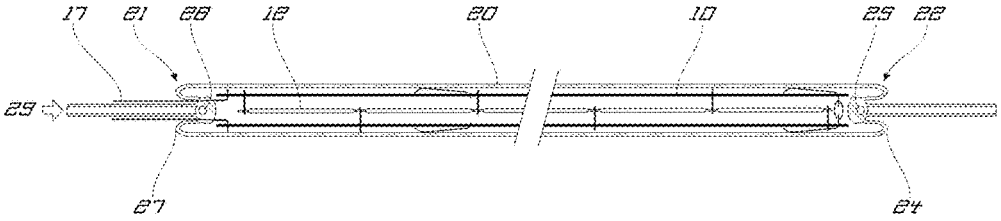

FIG. 4*f* illustrates the formation of the proximal hermetic seal 27. The proximal end 21 of the tubular glass envelope 20 is heated and collapsed around the flared rim of the proximal stem assembly 34*b*. Thus, the proximal end 21 is hermetically fused with the proximal stem assembly 34*b*. Since the electrical feedthrough components 17 are already hermetically sealed in the proximal stem assembly 34*b* in this embodiment, the step in FIG. 4*f* only comprises the joining of two glass components which may simplify the formation of the proximal hermetic seal 27. The formation of the proximal hermetic seal 27 can be performed before, during or after the formation of the distal hermetic seal 24, as long as the flow of coolant gas 29 through the exhaust tube of the proximal stem assembly 34*b* is ensured during the fusion process in which the proximal hermetic seal 27 is formed.

Figure 4G:
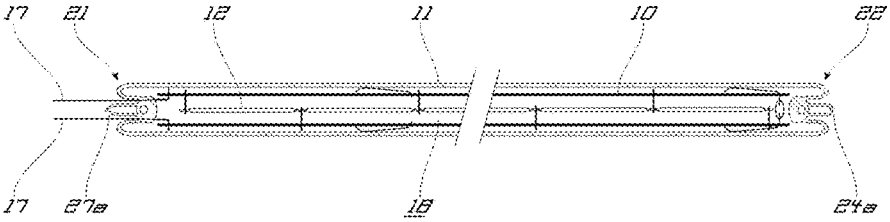

As in the previous embodiment (see FIG. 3*f*), after the formation of the proximal hermetic seal 27 is completed and the glass has cooled down, the tubular glass envelope 20 is filled with a suitable thermally conductive gas filling 18. Again, the gas filling 18 may be introduced via the openings 28 and/or 25 of the fused stem assemblies 34*a* and/or 34*b*. The light source mount assembly 10 and the gas filling 18 are then permanently sealed inside the tubular glass envelope 20 by fusion, and removal of the excess length of the protruding ends of the exhaust tubes of the stem assemblies 34*a* and 34*b*, to form a distal sealing tip 24*a* and a proximal sealing tip 27*a* and provide a sealed lamp envelope 11. This is shown in FIG. 4*g*.

Figure 4H:
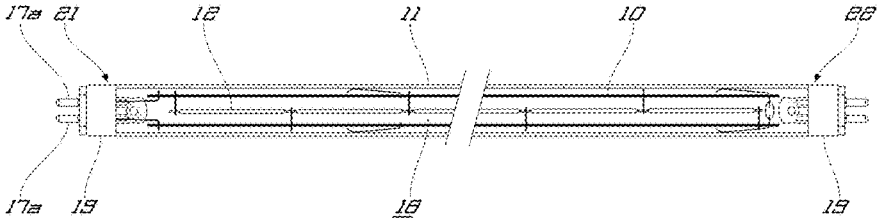

Finally, as in the previous embodiment, the optional bases 19 for forming the electrical and/or mechanical interface between the linear LED light source and corresponding sockets or holders may be applied over the proximal and/or distal ends 21, 22 of the sealed lamp envelope 11. In order to establish an electrical contact to the outside, the electrical feedthrough components 17 are shortened to a suitable length and connected to electrical contacts 17*a* of one or both of the bases 19. This is shown in FIG. 4*h*.

A third preferred embodiment with a modified stem assembly will now be described with reference to FIG. 5.

Figure 5A:
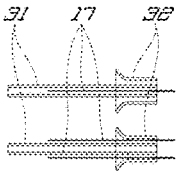
FIG. 5*a*-5*h* illustrate another modified method for manufacturing a linear LED light source according to an embodiment of the present invention.
Figure 5B:
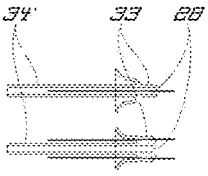
Figure 5C:
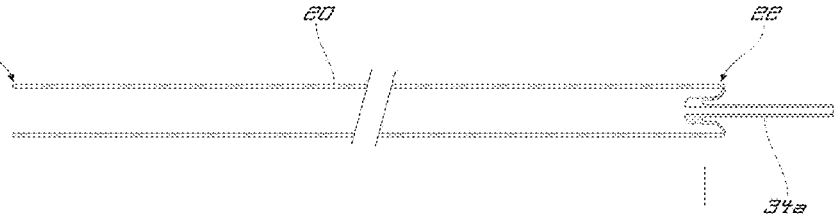
Figure 5D:
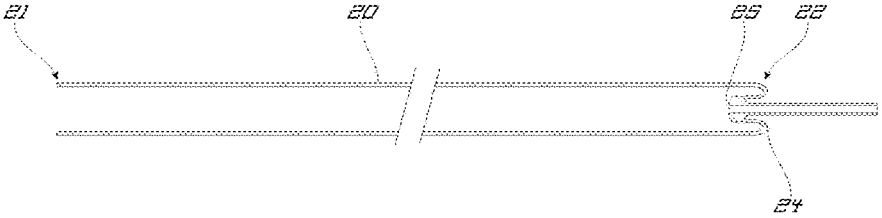
Figure 5E:
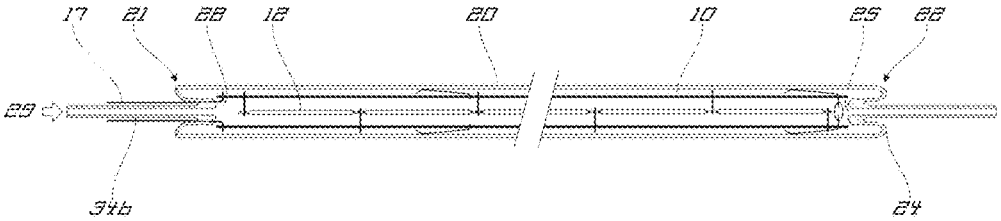
Figure 5F:
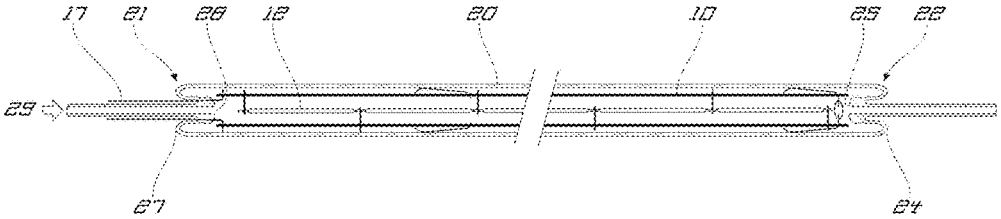
Figure 5G:
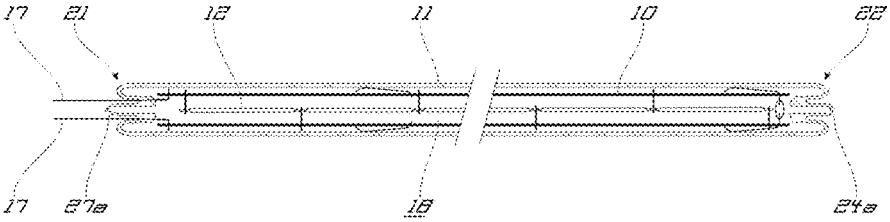
Figure 5H:
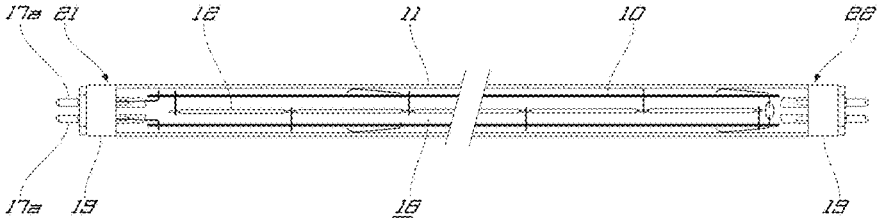

FIG. 5*a* illustrates the stem components comprising the flare tube 32, the exhaust tube 31 and the electrical feedthrough components 17. FIG. 5*b* illustrates the modified stem assembly 34' produced by the fusion of these parts. Whereas in the stem assembly detailed in FIG. 4*b* the opening 28 is blown laterally in the side wall of the fused hermetic seal 33 of the stem, in this modified assembly the opening 28 passes axially along the entire length of the stem assembly 34'.

FIG. 5*b* through 5*h* illustrate the subsequent assembly of the linear LED light source using the modified stem assembly 34' of FIG. 5*b*, and will not be described in detail owing to the similarity of the process already described with relation to FIG. 4*c*-4*h*. The main difference is that when the coolant gas flow 29 is introduced into the fused exhaust tube 31 of the stem assembly 34', the gas flows in a straight line through the stem and into the tubular glass envelope 20 without deviation from its axis. The flow of coolant gas 29 therefore impinges directly on the LED units 12 with reduced contact with the hot sidewall of the tubular lamp envelope 20, thereby reducing the risk of chilling the hot glass and producing stresses which may later cause residual stress of the glass.

Three modifications of a method for manufacturing a linear LED source according to the present invention have been described above. The three methods differ in the formation of the hermetic seals 27, 24. It is conceivable that the proximal hermetic seal 27 according to the modification of FIGS. 4*a* to 4*i* is further modified by carrying out the steps shown in FIGS. 4*a* and 4*b*, inserting the stem assembly 34 thus formed into the proximal end 21 of the tubular glass envelope 20 and collapsing the proximal end 21 of the tubular glass envelope 20 around the stem assembly 34 in order to form the proximal hermetic seal 27, and connecting the light mount assembly 10 to the electrical feedthrough components 17 at the proximal end 21 of the tubular glass envelope 20 that are already fused in the proximal hermetic seal 27.

The formation of the distal hermetic seal 24 could be modified as well. Furthermore, the stem assembly 34*a* bearing the electrical feedthrough components 17 could be inserted into and fused with the tubular envelope 20 before connecting the light source mount assembly 10, so that the connection of the light mount assembly 10 to the electrical feedthrough component 17 is performed with the electrical feedthrough component 17 already being hermetically sealed to the tubular glass envelope 20.

However, in any conceivable modification of the manufacturing process, a central concept of the present invention that needs to be accounted for is the provision and maintenance of the flow of coolant gas 29 through the tubular envelope 20 during every hermetic seal operation that is performed when the light source mount assembly 10 is already inserted into the tubular envelope 20, in order to prevent damages to the LED units 12 during the hermetic seal formation.

In the description, the term "proximal" designates the side of the linear LED light source from which the light source mount assembly is inserted and is used to distinguish the two sides of the linear LED source in the description. It is not intended to imply any further limitations. The light source mount assembly could also be inserted from the distal end, using one of the described alternatives for forming a hermetic seal, or using another method altogether.

It is noted that the present invention has been motivated in the context of LED filament light sources. It is, however, emphasised that the present invention is also applicable to conventional linear LED light sources in which the one or more LED units 12 are constituted by LEDs mounted on a printed circuit board or an equivalent carrier and arranged inside the sealed lamp envelope 11. The one or more LED units 12 may also be constituted by LED packages as defined in the International Electrotechnical Vocabulary (IEC 60050). According to this definition, a LED package is an electric component comprising at least one LED die, and can include optical elements, light converters such as phosphors, thermal, mechanical and electric interfaces, as well as components to address ESD concerns.

LIST OF REFERENCE SIGNS

10 light source mount assembly
11 sealed lamp envelope
12 LED unit
13*a*, 13*b* support frame
14 spacer component
15 isolating bridge
16 buffer spring
17 electrical feedthrough component
17*a* electrical contact
18 gas filling
19 base
19*a* adhesive
20 tubular glass envelope
21 proximal end
22 distal end
23 first exhaust tube
24 distal hermetic seal
24*a* distal sealing tip
25 distal opening
26 second exhaust tube
27 proximal hermetic seal
27*a* proximal sealing tip
28 proximal opening
29 flow of coolant gas
31 exhaust tube
32 flare tube
33 fused hermetic seal
34, 34*a*, 34*b*, 34' stem assembly
L length
d diameter
$d_i$ inner diameter

The invention claimed is:

1. A method for manufacturing a linear LED light source, comprising:

providing a tubular glass envelope that is open at its proximal end and its distal end;

inserting a light source mount assembly comprising one or more LED units into the tubular glass envelope;

forming a distal hermetic seal at the distal end such that a distal opening remains at the distal end;

forming a proximal hermetic seal at the proximal end such that a proximal opening remains at the proximal end;

maintaining a flow of coolant gas through the tubular glass envelope during the formation of one or both of the hermetic seals, wherein the insertion of the light source mount assembly is performed before the formation of said one or both hermetic seals;

filling the tubular glass envelope with a gas filling; and sealing the distal and proximal openings to obtain a sealed lamp envelope.

2. The method according to claim 1, wherein the diameter of the distal opening, the proximal opening, or both openings has a smaller diameter than the diameter of the tubular glass envelope.

3. The method according to claim 1, wherein the forming of the distal hermetic seal comprises the steps of:

inserting a second glass tube into the distal end such that an end of the second glass tube protrudes beyond the distal end to the outside of the tubular glass envelope; and forming the distal hermetic seal at the junction of the tubular glass envelope and the second glass tube by heating the distal end in order to collapse the distal end around the second glass tube.

4. The method according to claim 1, wherein the forming of the proximal hermetic seal comprises the steps of:

inserting a third glass tube into the proximal end such that an end of the third glass tube protrudes beyond the proximal end to the outside of the tubular glass envelope; and forming the proximal hermetic seal at the junction of the tubular glass envelope and the third glass tube by heating the proximal end in order to collapse the proximal end around the third glass tube.

5. The method according to claim 1, wherein the light source mount assembly is provided with at least one electrical feedthrough component connected thereto, wherein the electrical feedthrough component is arranged to protrude beyond the proximal end to the outside of the tubular glass envelope when the light source mount assembly is inserted into the tubular glass envelope, and wherein, in the forming of the proximal hermetic seal, the proximal end is heated such that the proximal end collapses around the electrical feedthrough component to form a hermetic seal around the electrical feedthrough component.

6. The method according to claim 1, further comprising, before inserting the light source mount assembly into the tubular glass envelope:

providing a stem assembly with an integral gas flow tube through which gas can flow, which stem assembly is hermetically sealed to an electrical feedthrough component; and connecting the electrical feedthrough component to the light source mount assembly;

wherein, when inserting the light source mount assembly into the tubular glass envelope, the stem assembly is partially inserted into the tubular glass envelope, with the integral gas flow tube protruding beyond the proximal end, and wherein the forming of the proximal hermetic seal is performed at the junction of the tubular glass envelope and the stem assembly by heating the proximal end in order to collapse the proximal end around the stem assembly.

7. The method according to claim 5, wherein the electrical feedthrough component comprises a controlled expansion alloy.

8. The method according to claim 1, comprising the step of applying bases at the distal end, the proximal end, or both ends of the sealed lamp envelope.

9. The method according to claim 1, wherein the distal hermetic seal is formed before the light source mount assembly is inserted into the tubular glass envelope.

10. The method according to claim 9, wherein the flow of coolant gas is introduced through the third glass tube before forming the proximal hermetic seal and maintained throughout the formation of the proximal hermetic seal.

11. The method according to claim 1, wherein the sealing of the first opening, the sealing of the second opening, or the sealing of both openings comprises fusing and removing the protruding ends of the second glass tube, the third glass tube, or both the second and third glass tubes.

12. The method according to claim 1, wherein the flow of coolant gas comprises nitrogen or argon or a mixture thereof.

13. The method according to claim 1, wherein the gas filling comprises hydrogen or helium or a mixture thereof.

14. The method according to claim 1, wherein at least one LED unit is constituted by a LED filament.

15. The method according to claim 1, wherein the distance between the proximal end of the sealed lamp envelope and the nearest LED unit is smaller than four times the diameter of the sealed lamp envelope, and/or wherein the distance between the distal end of the sealed lamp envelope and the nearest LED unit is smaller than four times the diameter of the sealed lamp envelope.

16. A linear LED light source, made by the method according to claim 1, comprising:

the sealed lamp envelope having a cylindrical shape having a diameter; and the light source mount assembly with the one or more LED units arranged inside the sealed lamp envelope;

wherein the distance between the LED unit and one or both of the distal end and proximal end is smaller than four times the diameter of the sealed lamp envelope.

17. The linear LED light source according to claim 16, wherein the LED units are sequentially arranged along the longitudinal axis of the sealed lamp envelope.

18. The linear LED light source according to claim 16, wherein at least one of the LED units include a LED filament.

19. The linear LED light source according to claim 16, wherein the light source mount assembly comprises support frames to which the LED units are mounted, and that are configured to conduct electric power for driving the LED units.

20. The linear LED light source according to claim 19, wherein the light source mount assembly comprises buffer springs that are configured to support the support frames against an inner wall of the sealed lamp envelope.

21. The linear LED light source according to claim 19, wherein:

the support frames are metallic; and the light source mount assembly comprises isolating bridges that are provided between the support frames and are configured to maintain a fixed relative position between the support frames.

22. The method according to claim 1, wherein the maintained flow of coolant gas is introduced via one of the openings and exits the other of the openings.

* * * * *